US007464794B2

(12) United States Patent
Badaoui et al.

(10) Patent No.: US 7,464,794 B2
(45) Date of Patent: Dec. 16, 2008

(54) COUPLING DEVICE FOR ELEVATOR CAR DOORS AND LANDING DOORS

(75) Inventors: Amine Badaoui, Briare (FR); Jean-Pierre Tantis, Bonny sur Loire (FR)

(73) Assignee: Otis Elevator Company, Farmington, CT (US)

( * ) Notice: Subject to any disclaimer, the term of this patent is extended or adjusted under 35 U.S.C. 154(b) by 174 days.

(21) Appl. No.: 10/589,478

(22) PCT Filed: Mar. 22, 2004

(86) PCT No.: PCT/IB2004/000917

§ 371 (c)(1),
(2), (4) Date: Aug. 14, 2006

(87) PCT Pub. No.: WO2005/092772

PCT Pub. Date: Oct. 6, 2005

(65) Prior Publication Data

US 2007/0205059 A1 Sep. 6, 2007

(51) Int. Cl.
*B66B 13/02* (2006.01)

(52) U.S. Cl. ..... 187/330; 187/319; 187/327; 49/117; 49/120; 49/370

(58) Field of Classification Search ..... 187/319, 187/327, 330, 334, 335; 49/117, 118, 120, 49/122, 366, 370; *B66B 13/12*
See application file for complete search history.

(56) References Cited

U.S. PATENT DOCUMENTS 4,947,964 A * 8/1990 Husmann ..... 187/319
6,474,448 B1 * 11/2002 Zappa ..... 187/339

FOREIGN PATENT DOCUMENTS

ES 2 119 650 A 10/1998
WO WO 03/089356 A 10/2003

OTHER PUBLICATIONS

PCT International Preliminary Report on Patentability for PCT/IB2004/000917, dated Jul. 5, 2006.

* cited by examiner

*Primary Examiner*—Peter M Cuomo
*Assistant Examiner*—Stefan Kruer

(57) ABSTRACT

The invention is relating to a coupling device for elevator car (5) and landing doors of the kind comprising moving cams (3) integral with the car door (5) and driving the landing door in front of a story landing by means of a coupling plate integral therewith and engaging with the cams (3), locking it mechanically and electrically upon door closure to allow the subsequent drive of the car, wherein said cams (3) are movably mounted with a variable distance from each other on the car door (5), independently from the car door drive belt (19), and a part (7) is provided to drive the cams (3) with a variable distance, which part (7) is mounted on the car door (5) and connected to the drive belt (19) and to one of the cams (3) to drive it towards and away from the other cam (3) with a large displacement relative to a small overtravel drive of the belt (19), in order to respectively allow to unlock the coupling plate and its landing door drive coupling when the doors open and to lock it when they close.

8 Claims, 3 Drawing Sheets

COUPLING DEVICE FOR ELEVATOR CAR DOORS AND LANDING DOORS

FIELD OF THE INVENTION

This invention relates to a coupling device for elevator car doors and landing doors, and in particular a coupling device for car and landing doors of the type with a door drive overtravel on door opening or closure.

DESCRIPTION OF THE RELATED ART

Coupling devices for car and landing doors of this type are known to use a door coupling cam hinge part that is connected to the car door drive belt and the landing door drive cams and drives the latter apart as the door opens or towards each other on door closure. However, this part is submitted to a high torsion stress that can eventually damage it, when driving the cams on one hand, and when driving the doors on the other hand, in particular when the door panels are heavy. In addition, because of its generally T-shaped design, it requires a large overtravel of the belt at low speed to drive the cams and thus allow the mechanical and electrical locking or unlocking of the door coupling plate. This overtravel time for locking or unlocking is relatively long, approximately 0.5 to 1 second adding to the travel time of the door panels, and is disadvantageous for elevator traffic management as well as in terms of waiting time and travel time of users.

SUMMARY OF THE INVENTION

This invention aims at suppressing these drawbacks and proposes a coupling device for elevator car and landing doors of the kind comprising moving cams integral with the car door and driving the landing door in front of a story landing by means of a coupling plate integral therewith and engaging with the cams, locking it mechanically and electrically upon door closure to allow the subsequent drive of the car, characterized in that said cams are movably mounted with a variable distance from each other on the car door, independently from the car door drive belt, and that it comprises a part to drive the cams with a variable distance, which is mounted on the car door and connected to the drive belt and to one of the cams, said part exerting a lever action on said cam to drive it towards and away from the other cam with a large displacement relative to a small overtravel drive of the belt, in order to respectively allow to unlock the coupling plate and its landing door drive coupling when the doors open and to lock it when they close.

Said part to drive the cams apart is advantageously a connecting rod hinged on the car door support trolley panel and hinged by an attachment tab to the door drive belt and to said driven cam, wherein the ratio between the distance from the connecting rod attachment point to the belt on the hinging point of the connecting rod on the trolley and the distance from said connecting rod hinge point to the attachment point on the cam is largely lower than 1, obviously varying according to the length of the connecting rod, generally lower than ⅓ and generally equal to approximately 7/30, so that a 7 mm overtravel of the belt relative to the opening or closure of the door drives the cams towards or apart from each other, respectively, by an additional 30 mm.

This opening position of the cams unlocking mechanically and electrically the landing door coupling plate is advantageously locked in position with an appropriate distance between the cams so as to maintain the plate unlocked, by means of a locking element that mechanically engages the cam drive connecting rod or said driven cam brought into its final drive position, and preferably by means of a final position stop against the connecting rod and of an associated hook element with a self-snapping engagement, locking the connecting rod in position, wherein these elements engage as soon as the car door drive belt has been driven over a determined overtravel length as the doors open and close.

The cams are advantageously mounted movably with a variable distance from each other on the car door, by means of a set of two upper and lower connecting rods hinged in a vertical parallelogram connected to the car door in their middle and to the cams at their ends, wherein the displacement of the cam connected to the drive rod is coordinated with the displacement of the corresponding terminal hinge point of the cam drive connecting rod.

The cam drive connecting rod can be replaced by a set of two connecting rods hinged to each other, the first rod being connected to the drive belt and hinged to the car door and the other being linked to the driven cam, which makes cam drive coordination easier.

The landing door coupling plate or lock plate is conventional and includes two rollers each rolling on each of the opposite upper sides of the cams, a catch picking element for the landing door acting when the cams come closer on door closure and released when the cams move apart as the doors open, and an electrical landing door locking contact element operating in the same way as the catch picking element and closing the elevator car control circuit.

This invention also deals with an elevator equipped with a car and landing door coupling device as defined above.

BRIEF DESCRIPTION OF THE DRAWINGS

The invention is illustrated hereafter by reference to a preferred embodiment of the invention and to the appended drawings, in which.

DETAILED DESCRIPTION

Figure 1:
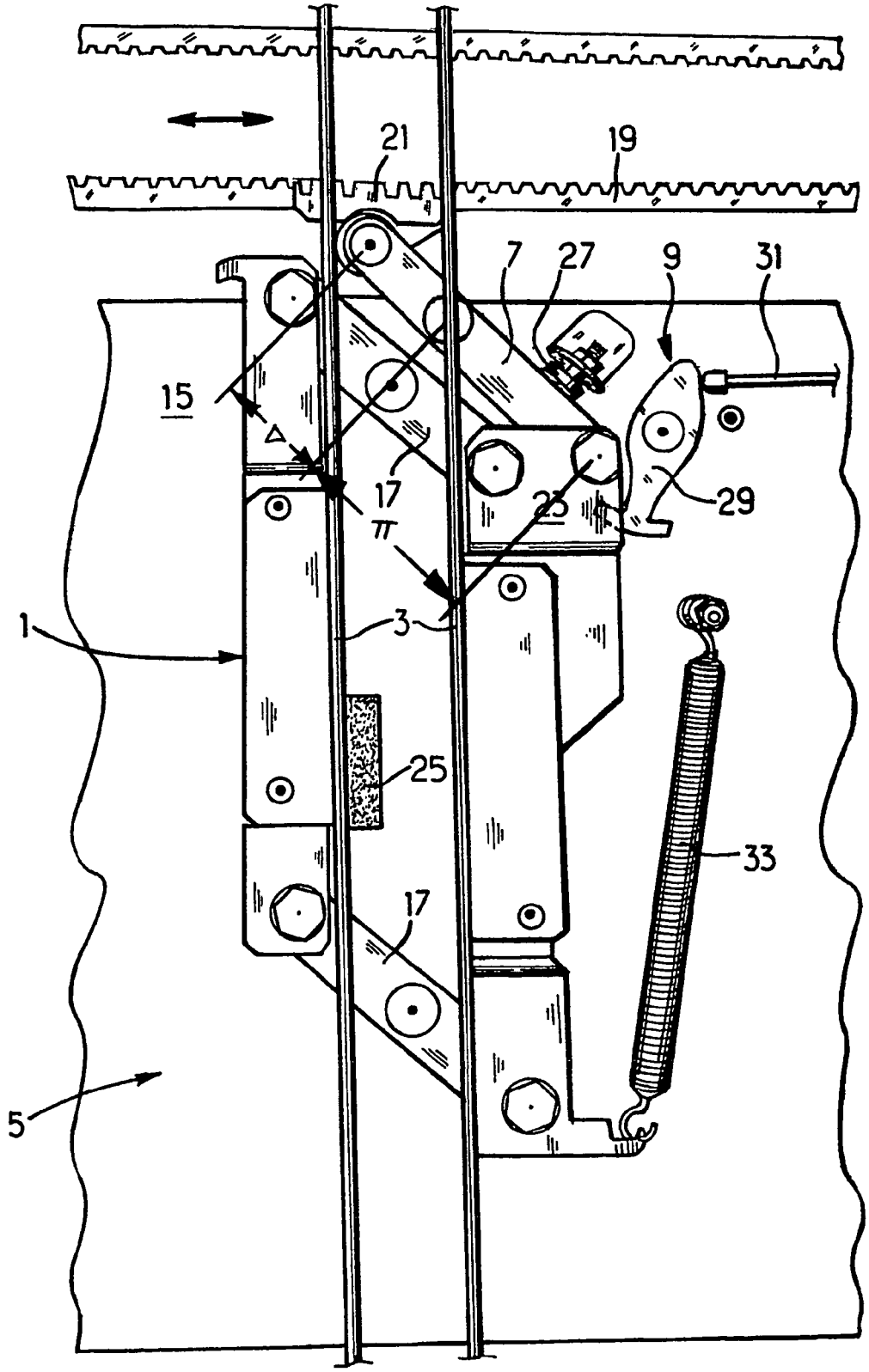
FIG. 1 is a schematic elevation view of a car and landing door coupling device for an elevator according to the invention in its operational coupled position (when the doors open)
Figure 2:
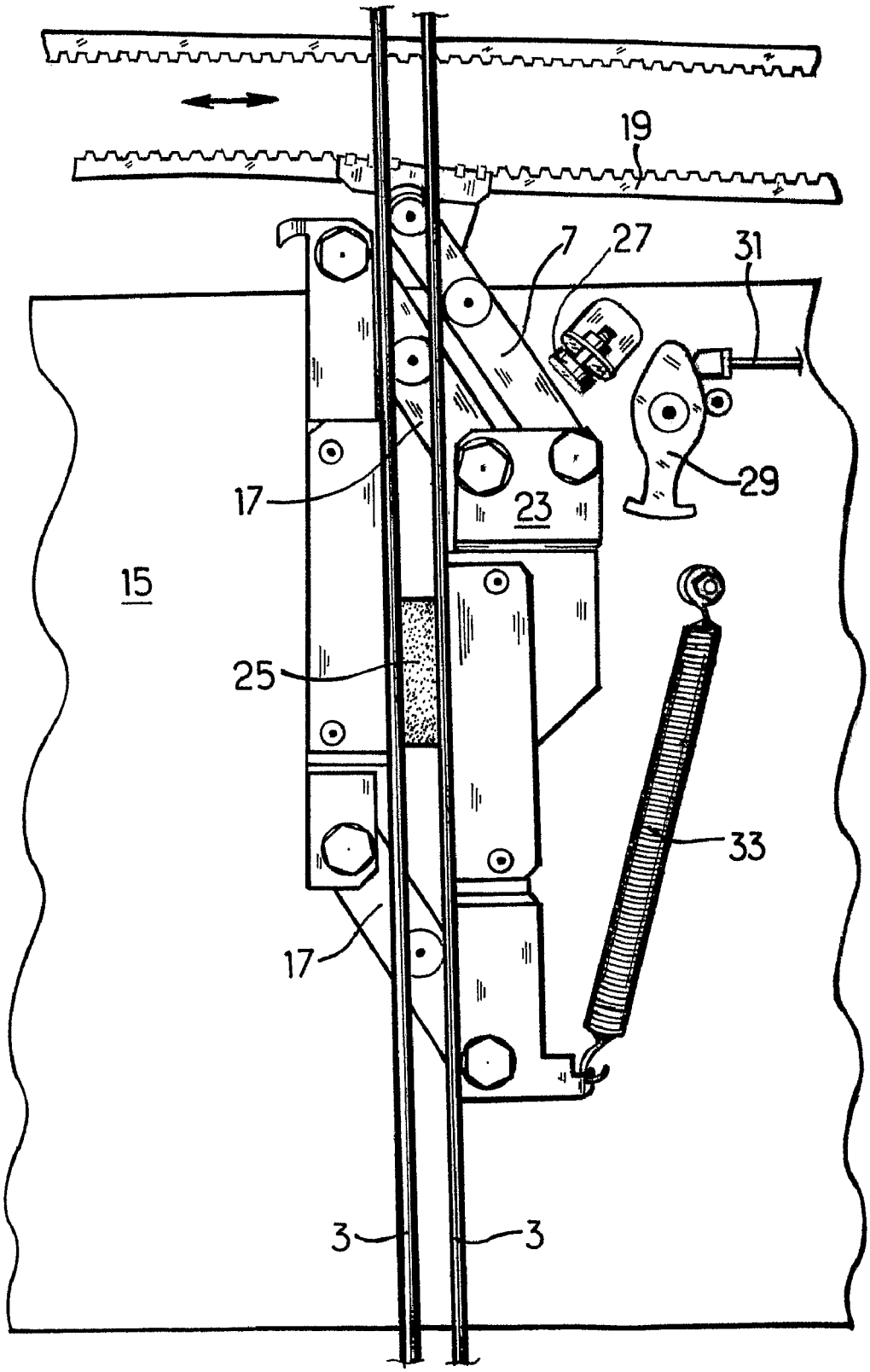
FIG. 2 is a view similar to FIG. 1 showing the device in its uncoupled position with the locking plate locked to close the doors.
Figure 3:
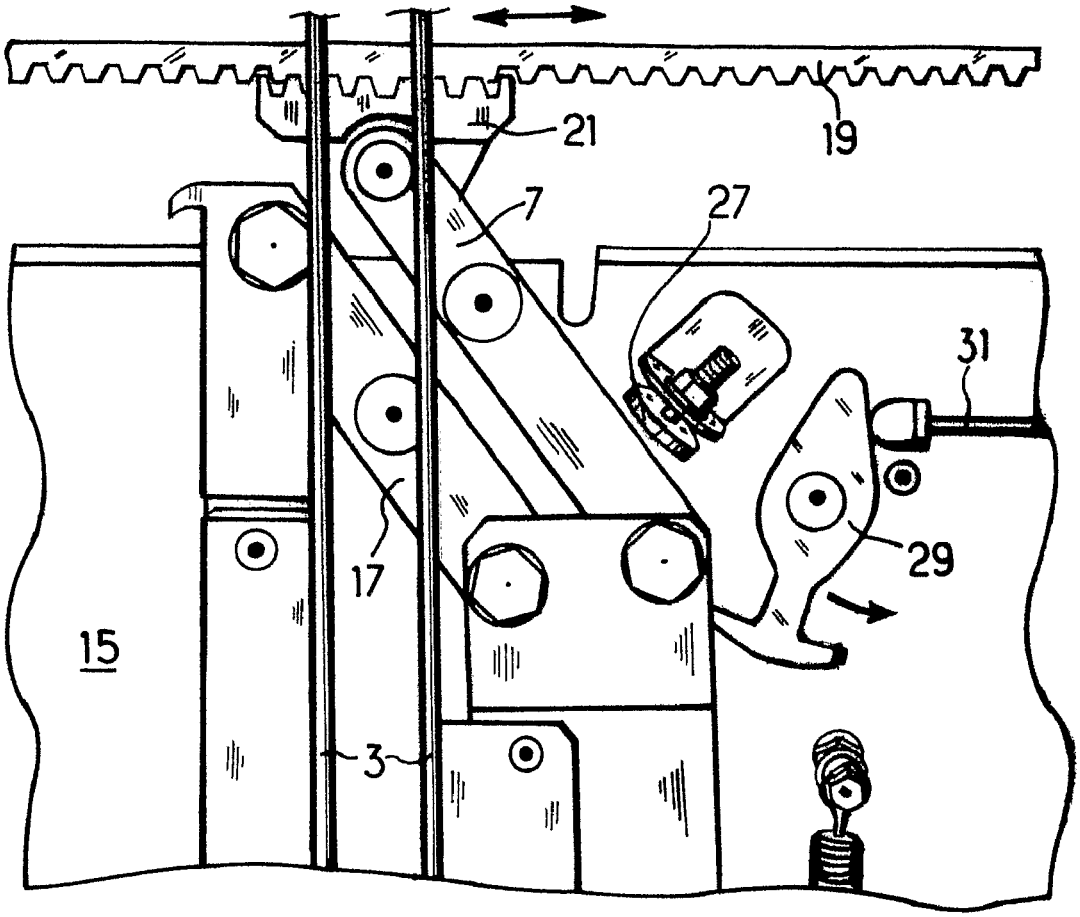
FIG. 3 shows the device during uncoupling, during the overtravel of the door drive belt.

Referring to the pictures, and in particular to FIGS. 1 to 3, the coupling device 1 for elevator car and landing doors according to the invention essentially comprises two vertical oblong cams 3 mounted in a hinged fashion and with a variable spacing on the elevator car door 5, a connecting rod 7 to drive the cams 3 with a variable spacing, a cam position locking device 9 and a coupling plate 11 (FIG. 4) engaged on the cams 3 and attached to the landing door 13, which is arranged opposite the car door 5 at each landing stop of the car.

The oblong cams 3 are more precisely mounted on the upper trolley panel 15 or "car door hanger" which is integral with the car door and is supporting the car door panel, which trolley panel is driven to roll on an upper horizontal rail (not represented) arranged above the opening of the car integrally therewith. These cams 3 are mounted on the trolley panel 15 by means of two identical connecting rods 17 hinged in their middle to the trolley panel and hinged at their ends to the cams 3 in a parallelogram arrangement. The cams 3 are thus supported in a parallel arrangement with a variable spacing and connected to each other by said two parallel connecting rods 17, wherein their spacing varies according to the orientation of the connecting rods, which are substantially under 45° relative to the vertical when the cams are at their maximum spacing and 30° relative to the vertical at their minimum spacing.

The connecting rod 7 is slightly longer than the cam supporting rods 17 and is connected to the drive belt 19 of the car door actuator by means of an attachment tab 21 to which it is hinged; it is hinged at substantially one third of its length to the upper part of the trolley panel 15 and is attached, on the other hand, to one of said two cams 3, the one on the right on the figure, by a lateral tab 23 to which it is hinged. This connecting rod 7 is substantially parallel to the cam connecting rods 17. The ratio of the distances from its hinging point to its terminal hinging points is of about ½ with a length from the hinging point to the cam about twice as great as that from the hinging point to the belt. This arrangement allows increasing the displacement of the cams 3 apart from and towards each other relative to the displacement of the belt 19 during the overtravel of the belt at reduced speed, to drive the cams apart (FIG. 3) from their close-up configuration (FIG. 2) when the doors open to their maximum spacing (FIG. 1) and inversely, to drive them closer when the doors close up to the configuration of FIG. 2, wherein the car door 5 is arrested in abutment and the belt overtravels. In this process, it takes little time to drive the cams apart and thus to unlock the coupling plate 11 to allow the opening drive of the car and landing doors 5 and 13, this displacement from each other being almost instantaneous whereas, in the conventional coupling device as defined above, it required 0.5 to 1 second, and inversely to drive the cams closer to each other when the doors close to allow a fast mechanical and electrical locking of the coupling plate, as will be described later.

The cam position locking device 9 is made of a foam pad 25 attached to one of the cams 3 and forming an abutment for the other cam in the minimum distance position (16 mm), and by a set of a rubber pad stop 27 bearing against the drive rod 7, at the maximum distance between cams (46 mm), and of a latch element 29 hooking under the end of the connecting rod 7 to hold it in position against the stop 27. The latch element 29 is mounted to rotate on the trolley panel, being returned by a coil spring on its axes, turned to the connecting rod 7 in the hooked position, whereas a fixed rod 31 integral which the car frame, more precisely the car lintel, contacts the upper end away from the hook as the doors close to release the locking and allow the cams to move towards each other.

It should be noted that the opening of the cams is assisted by a coil spring 33 arranged laterally with respect to the cams 3, attached to the trolley panel 15 and connected to one of the cams. This spring 33 also takes up the residual play of the connecting rods 7, 17, thus preventing operating vibration and noise.

Figure 4:
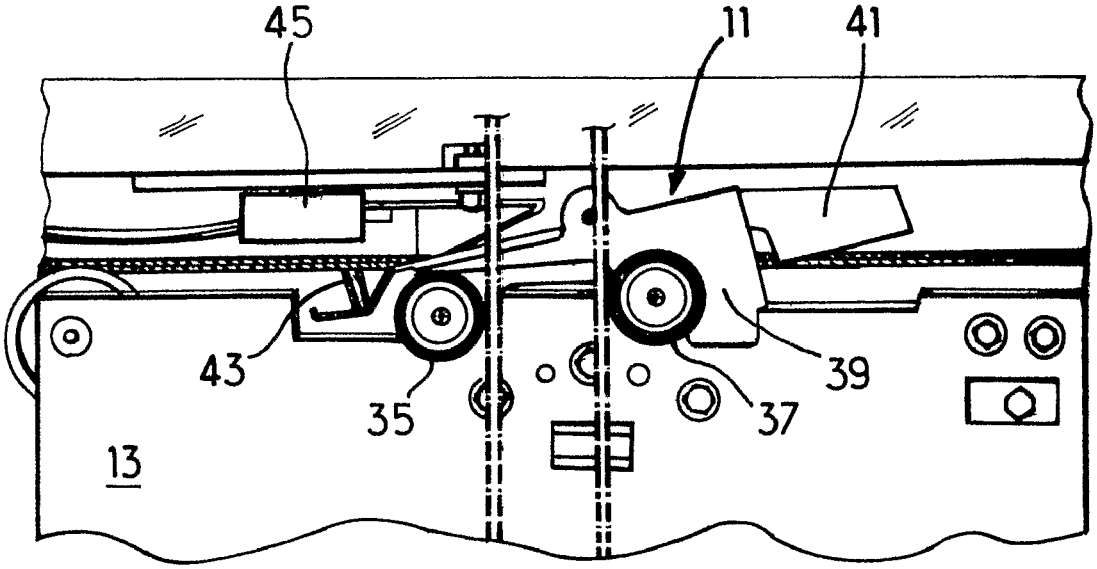
FIG. 4 is an elevation view of the coupling plate in its unlocked position.

The coupling plate 11 represented on FIG. 4 is conventional. It is hinged on the landing door 13 with a stationary roller 35 and a movable roller 37 integral with a hinged part 39, which bears a counterweight 41 at one end and an electrical contact 43 at the opposite end, wherein the counterweight 41 brings the hinged part 39 and its roller 37 closer to the stationary roller 35 and its contact element 43 locked to close the circuit on the complementary electrical receptacle 45 by gravity, while its laterally cut-out hook part 47 engages a complementary stationary hook 49.

The rollers 35 and 37 come on either side of the cams 3 and, when the latter move apart from each other, the hinged part 39 is pushed back by its roller 37 displaced in contact with the corresponding cam 3 and the counterweight 41 moves upwards again. The hinged part releases the hook 49 and removes the contact element 43 from its receptacle to open the car control circuit, so that the coupling plate 11 is unlocked and allows the landing door to move at the same time as the car door, opposite it and without any play.

The operation of the device shall now be described and is the continuation of the preceding description.

Starting from a coupling condition of the car and landing doors in which the doors are opened and driven together with each other (FIG. 1) by means of the unlocked landing door coupling plate 11 (FIG. 4), with the cams being parted, towards a door closure movement, the coupling device changes its state upon door closure when the car door panel 5 abuts and stops to be closed. At that time, the belt 19 in overtravel drives the connecting rod 7, at low speed, on a small distance in the direction of the cams coming closer together (FIG. 3), along about 5 to 10 mm, to move the cams by approximately 30 mm closer to each other until they abut on the pad 25 (FIG. 2). Thus the coupling plate is mechanically locked by its hook 47, which blocks the landing door with its frame, and closes the electric car control circuit by means of its terminal contact element 43 to allow the control for further displacement of the elevator car.

The doors open following the reverse order of the sequence described above.

The invention is obviously not limited to the exemplary embodiment described and variants may be designed regarding the possibility of another arrangement than cams on the car door, for example only one movable cam connected to the drive rod, the possibility to directly lock the cams in their spread apart position, or the use of a drive rod made of two articulated parts, one being hinged to the drive belt and the car door and the other being linked to the driven cam.

The invention claimed is:

1. Coupling device for an elevator car door and an elevator landing door comprising:

cams integral with the car door and driving the landing door, said cams being movably mounted with a variable distance from each other on the car door, independently from a car door drive belt; and a connecting drive rod to separate the cams with a variable distance, wherein the connecting drive rod is mounted on the car door, wherein the connecting drive rod is connected to the car door drive belt and to one of the cams, wherein said connecting drive rod is configured to exert a lever action on said one of the cams to drive said one of the cams towards and away from another of the cams with a large displacement relative to a small overtravel drive of the car door drive belt, in order to: (a) unlock a coupling plate and a landing door drive coupling when the doors open; and (b) lock the coupling plate and the landing door drive coupling when the doors close, wherein said connecting drive rod is: (a) hinged at a first point on a trolley panel of the car door; (b) hinged at a second point on an attachment tab to the car door drive belt; and (c) hinged at a third point on said driven cam, wherein a dimension $\Delta$ is a distance from the first point at which the connecting drive rod is hinged to the trolley panel to the second point at which the connecting drive rod is hinged to the car door drive belt, wherein a dimension $\pi$ is a distance from the first point at which the connecting drive rod is hinged to the trolley panel to the third point at which the connecting drive rod is hinged to the driven cam, and wherein a ratio of $\Delta$ to $\pi$ is less than 1.

2. Coupling device according to claim 1, wherein the ration of $\Delta$ to $\pi$ is less than about ½.

3. Coupling device according to claim 1, wherein an opening position of the cams unlocking mechanically and electrically the coupling plate is advantageously locked in position with an appropriate distance between the cams so as to maintain the plate unlocked, by means of a locking element that mechanically engages the connecting drive rod or said driven cam.

4. Coupling device according to claim 1, wherein the cams are mounted movably with a variable distance from each other on the car door, by means of an upper connecting rod and a lower connecting rod hinged in a vertical parallelogram, wherein central portions of each of the upper connecting rod and the lower connecting rod are connected to the car door, wherein the first ends of the upper connecting rod and the lower connecting rods are connected to said one of the cams, wherein second ends of the upper connecting rod and the lower connecting rod are connected to the another of the cams.

5. Coupling device according to claim 1, wherein the connecting drive rod is defined by a set of two connecting rods hinged to each other, the first rod being hinged to the car door and connected to the drive belt and the second being linked to the driven cam.

6. Elevator comprising a coupling device for the car door and the landing doors according to claim 1.

7. Coupling device according to claim 2, wherein a 7 mm overtravel of the belt relative to the opening or closure of the door drives the cams towards or apart from each other, respectively, by an additional 30 mm.

8. Coupling device according to claim 3, wherein the cam opening position is locked in position by means of a final position stop against the connecting drive rod and of an associated hook element with a self-snapping engagement, locking the connecting drive rod in position, and wherein these elements engage as soon as the car door drive belt has been driven over a determined overtravel length as the doors open and close.

* * * * *